United States Patent [19]

Nelis

[11] Patent Number: 4,724,070

[45] Date of Patent: Feb. 9, 1988

[54] PROCESS FOR THE DECOMPOSITION OF POLYHALOGENATED AROMATIC COMPOUNDS

[75] Inventor: Philippe Nelis, Mont Saint-Guibert, Belgium

[73] Assignee: Labofina, S.A., Brussels, Belgium

[21] Appl. No.: 8,335

[22] Filed: Jan. 29, 1987

[51] Int. Cl.[4] ..... C10G 17/00

[52] U.S. Cl. ..... 208/262

[58] Field of Search ..... 208/262

[56] References Cited

U.S. PATENT DOCUMENTS 4,351,718 9/1982 Brunelle ..... 208/262

4,400,552 8/1983 Pytlewski et al. ..... 568/715

*Primary Examiner*—Curtis R. Davis

*Attorney, Agent, or Firm*—Roger W. Parkhurst; John K. Abokhair; M. Norwood Cheairs

[57] ABSTRACT

The decomposition of polyhalogenated aromatic compounds, such as polychlorinated biphenyls (PCB), is carried out under an inert atmosphere using a reagent comprising a polyglycol partially neutralized with sodium, and a weakly basic compound.

11 Claims, No Drawings

PROCESS FOR THE DECOMPOSITION OF POLYHALOGENATED AROMATIC COMPOUNDS

TECHNICAL FIELD

The present invention relates to an improved process for the decomposition of polyhalogenated aromatic compounds, such as polychlorinated biphenyls (PCB). It relates more particularly to a method for the decontamination of mineral oils containing polychlorinated biphenyls and/or other polyhalogenated aromatic compounds.

BACKGROUND OF THE INVENTION

Polyhalogenated aromatic compounds exhibit a very high chemical stability and are resistant to biodegradation. They are soluble in fatty materials and tend to accumulate in animal lipids, thus producing an increase of their concentration in the food chain. Several studies have clearly shown the intrinsic toxicity of these compounds and also their potential toxicity during a thermal treatment. When heated at a temperature from 300° to 900° C. in the presence of air, PCB produce dioxins and benzofurans, some isomers of which are still more toxic.

For these reasons, several institutions for environmental protection have promulgated strict regulations concerning the use of commercial compositions containing polyhalogenated aromatic compounds. Accordingly, transformer oils are regularly controlled due to the likelihood of their contamination by polyhalogenated aromatic compounds. In fact, PCB were widely used as dielectric fluids in transformers. The transformer oils and other fluids are classified according to their contamination level. The U.S. Environmental Protection Agency has promulgated rules and PCB-containing oils can be broken down into the following categories:

PCB-free oils : oils containing less than 50 ppm PCB;

PCB-contaminated oils : oils containing 50–500 ppm PCB;

PCB oils : oils containing more than 500 ppm PCB.

Oils containing more than 50 ppm PCB can be eliminated by burning in high temperature incinerators, but the latter must meet several and strict monitoring conditions. Therefore, the treatment cost is high. Moreover, the valuable oil is completely destroyed and lost.

Chemical methods have been suggested for the decontamination of oils containing PCB and/or other polyhalogenated aromatic compounds. However, these compounds are chemically stable and their dehalogenation requires the use of specific and very active reactants, namely alkali metals such as sodium, to be effective.

According to one method, the content of PCB in a mineral oil may be reduced by treating it with a sodium dispersion in a hydrocarbon. However, this method has several drawbacks, e.g. the dehalogenation reaction must be carried out under anhydrous conditions and the process is slow, even at high temperature.

Other dehalogenation processes consist of using alkali metal alkoxides in the presence of some solvents. But, even at high temperatures, these processes are only efficient for the dehalogenation of monohalogenated compounds.

It has been further proposed to destroy a halogenated organic compound by treating it with a reagent obtained by reacting an alkali metal or its hydroxide with a polyglycol and with oxygen, the alkali metal being used in at least a stoichiometric amount. There is formation of a complex alkali metal glycolatesuperoxide radical (U.S. Pat. Nos. 4,337,368; 4,353,793; 4,400,552; 4,460,797; European patent application No. 60089). These processes present some drawbacks, e.g. the decontamination temperature is high and the treated oils are degraded.

In an attempt to remedy these limitations, it has been suggested to treat halogenated organic compounds with a mixture of reactants comprising a polyethylene glycol or similar polyglycol, a base and an oxidizing agent or other source of free radicals (European patent application No. 118858). However, this mixture is not sufficiently active and the decontamination reaction must be carried out with the aid of micro-waves in order to reduce the reaction time and to preserve the intrinsic qualities of the treated oil.

Thus, there exists a need for an efficient process for the decomposition of polyhalogenated aromatic compounds with an effective reagent which is not hazardous and is easily stored. It is also necessary that the application of said process for the treatment of mineral oils containing polyhalogenated aromatic compounds achieve a fast and very effective decontamination without any degradation of the treated oil.

SUMMARY OF THE INVENTION

The invention may be summarized as a process for the chemical decomposition of polyhalogenated aromatic compounds which comprises contacting these compounds with a reagent comprising (a) a sodium derivative of a polyglycol wherein the end-OH groups are partially neutralized with sodium, and (b) a weakly basic salt, said contact being carried out under an inert atmosphere.

According to one aspect of the invention, the process is employed for the decontamination of mineral oils containing polyhalogenated aromatic compounds. This embodiment comprises contacting the mineral oil with a reagent comprising (a) a sodium derivative of a polyglycol wherein the end-OH groups are partially neutralized with sodium, and (b) a weakly basic salt, said contact being carried out under an inert atmosphere.

DETAILED DESCRIPTION OF THE INVENTION

The dehalogenation reagent comprises two components. The first component is a sodium derivative of a polyglycol wherein the end-OH groups are partially neutralized with sodium. The starting polyglycols are compounds having the formula $$HO\text{-}(RO)_n\text{-}H$$

wherein R is the radical $-CH_2CH_2-$ or $-CH_2CH(CH_3)-$ and n is an integer between 2 and 400. Examples of such starting polyglycols include polyethylene glycols, polypropylene glycols, copolymers of ethylene oxide and propylene oxide, and their mixtures. These compounds are either liquid or solid, depending upon their molecular weight. In order to facilitate the preparation of their sodium derivatives, it is advisable to employ liquid polyglycols or solid polyglycols having a low melting point. Polyethylene glycols wherein n is between 2 and 100 are advantageously employed.

The sodium derivatives of these polyglycols are compounds wherein some of the end-OH groups have reacted with sodium. These derivates may be represented by Formula 1:

$$[H_{1-x}—O-\{-RO-\}_n H_{1-y}]Na_{x+y} \quad \text{(Formula 1)}$$

wherein R and n have the same meaning as above, x and y are between 0 and 1 and x+y is between 0.3 and 1.9. Comparative experiments for the decontamination of mineral oils containing PCB have shown that the decontamination yield was practically zero when a polyglycol was used instead of a sodium derivative of polyglycol in the process of the invention. However, this yield reached 60% by using a sodium derivative of polyglycol wherein x+y was 0.4. The experiments have also shown that the decontamination yield increases asymptotically with an increase of the sum x+y. Generally, reagents containing sodium derivatives of polyglycols wherein x+y is between about 0.5 and 1.5, more particularly between 0.6 and 1.4, will be preferably employed. According to a preferred embodiment of this invention, the sodium derivatives are prepared from polyethylene glycols having a molecular weight between 400 and 1000 and the sum x+y is in the range of 0.6 to 1.2.

The second component of the reagent is a weakly basic compound. Examples of suitable weakly basic compounds include the carbonates and bicarbonates of sodium, potassium or lithium. The amount of weakly basic compound in the reagent may vary between wide limits. Valuable results are obtained when this amount is as low as 1% (based on the total weight of reagent). Reagents wherein the amount of weakly basic compound is between 1 and 10 weight % are generally used, as higher amounts of this compound do not improve the results. According to an embodiment of this invention wherein a sodium derivative of a polyethylene glycol having a molecular weight of about 400 is employed, the amount of weakly basic compound is generally between 4 and 10 weight %, based on the total amount of reagent.

The reagent employed in the process of this invention is easily prepared by mixing the components. It is not necessary to mix the components under an inert atmosphere. By way of example, the liquid or melted polyglycol is first blended with the weakly basic component, under slight heating. Solid sodium or a dispersion of sodium in a hydrocarbon is then slowly added. The color of the mixture is first orange and then becomes dark brown, when the entire required amount of sodium has been introduced.

The process of this invention for the chemical decomposition of polyghalogenated aromatic compounds or for the decontamination of mineral oils containing these compounds comprises contacting the product to be treated with the reagent, under an inert atmosphere. The amount of reagent to be used depends on the halogen content of the product and this content is easily determined by known methods. By way of example, a transformer oil containing 500 ppm Cl ex-PCB was contacted under a nitrogen atmosphere with a reagent comprising:

(a) a sodium derivative of polyethylene glycol having a molecular weight of 400, the sum x+y being 0.6, and (b) carbonate of potassium (8% of the total weight of reagent).

The decontamination reaction was carried out at a temperature of 130° C., for 60 minutes. The results of the tests are given in the following Table 1.

TABLE 1

| Weight of reagent (based on the weight of oontaminated oil | Residual Cl (ppm) | Decontamination yield |
|---|---|---|
| 2.5 | 160 | 68 |
| 5 | 50 | 90 |
| 10 | 16 | 96.8 |
| 15 | 14 | 97.2 |

The process of this invention may be carried out by using a reactor provided with a heating means and a stirrer. The reactor is first charged with the oil containing PCB and is then heated to the desired temperature, under stirring. Thereafter, the reagent is added and nitrogen is introduced into the reactor. Samples of the reaction mixture are withdrawn and cooled. After decantation, filtration and optional washing with water, the decontaminated oily fraction is analyzed by X rays and titration to determine the amount of residual chlorine.

The decontamination reaction is generally carried out at a temperature of at least 100° C. Higher temperatures increase the reaction rate, but they must be kept below the flash point of the treated oil. For this reason, the reaction temperature will be in the range of 100°-160° C. By heating to this temperature the oil is dehydrated, thereby avoiding a decrease of reactivity which would result from a high water content.

It has been found that the process of the present invention has the following advantages:

the chemical decomposition of polyhalogenated aromatic compounds and the decontamination of mineral oils containing these compounds may be carried out efficiently within a short reaction time;

the use of oxidizing agents or of compounds generating free radicals is not required;

specialized equipment is not required; and the treated oil is readily recovered by decantation and filtration without any degradation of its dielectric properties, thereby permitting its reuse.

The following examples illustrate certain embodiments of the present invention, but do not limit its scope.

EXAMPLE 1

A series of comparative tests were conducted for the decontamination of a transformer oil containing 870 ppm PCB.

The oil was treated with reagents in an amount of 5% based on the weight of oil.

The reagents contained sodium derivatives of polyethylene glycol having different indices x+y (see Formula 1) and also carbonate of potassium in an amount of between 4 and 10% based on the total weight of reagent.

The tests were carried out under nitrogen atmosphere, at 130° C. for 2½ hours.

The results are given in Table 2.

TABLE 2

| Indice x + y | Decontamination yield (%) |
|---|---|
| 0.2 | 65 |
| 0.4 | 88 |

TABLE 2-continued

| Indice x + y | Decontamination yield (%) |
|---|---|
| 0.6 | 95.5 |
| 1.0 | 99 |

EXAMPLE 2

The transformer oil of Example 1 was treated with a reagent containing a sodium derivative of polyethylene glycol having a molecular weight of 1000 (indice $x+y=0.6$) and carbonate of potassium (6% by weight, based on the weight of reagent).

The amount of reagent was 5%, based on the weight of oil. The test was carried out at 130° C. under nitrogen atmosphere.

After 1 hour, the decontamination yield was higher than 90%. After 2 hours, the oil was decontaminated.

The tangent delta of the decontaminated oil was $1.9\times10^{-3}$. Moreover, no discolouration of the oil occurs during the treatment.

EXAMPLE 3

The reagent of Example 2 was used for treating a transformer oil containing 10,000 ppm PCB.

The amount of reagent was 30%, based on the weight of oil. The treatment was carried out at 80° C.

After 7 hours, the oil was decontaminated.

EXAMPLE 4

The reagent of Example 2 was used for treating a transformer oil containing 870 ppm PCB.

The same amount of reagent (96 g) was employed for treating successively 5 different batches (100 g for each batch) of said oil. The treatment temperature was 130° C. The reaction time was limited to 1 hour for each batch.

The decontamination yield was higher than 96% for each treatment.

EXAMPLE 5

Comparative tests for the decontamination of a transformer oil containing 870 ppm PCB were carried out by using in each test the same amount of reagent comprising a sodium derivative of polyethylene glycol and carbonate of potassium. The carbonate content varied in each test.

The reaction was carried out at 130° C. The decontamination yields after 15 minutes and 2½ hours are given in Table 3.

TABLE 3

| Weight % $K_2CO_3$ in the reagent | Decontamination yield (%) after 15 minutes | Decontamination yield (%) after 2½ hours |
|---|---|---|
| 0 | 36 | 84 |
| 4 | 64 | 93 |
| 8 | 66 | 97 |
| 15 | 66 | 94 |

EXAMPLE 6

A transformer oil (600 g) containing 870 ppm PCB was treated with the reagent of Example 2 (60 g), at 130° C. and under nitrogen atmosphere.

The decontamination yields after different reaction times are given in Table 4.

TABLE 4

| Reaction time (in minutes) | Decontamination yield (%) |
|---|---|
| 15 | 87 |
| 30 | 93 |
| 45 | 96 |
| 60 | 97 |

What is claimed is:

1. A process for decomposing polyhalogenated aromatic compounds which comprises contacting said compounds under an inert atmosphere with a reagent comprising:
   (a) a sodium derivative of polyglycol, the end-OH groups of said polyglycol being partially neutralized by sodium, and
   (b) a weakly basic compound.

2. A process for decomposing polyhalogenated aromatic compounds in mineral oils and for decontaminating said oils, said process comprising contacting said oils under an inert atmosphere with a reagent comprising:
   (a) a sodium derivative of polyglycol, the end-OH groups of said polyglycol being partially neutralized by sodium, and
   (b) a weakly basic compound.

3. The process of claim 1, wherein the sodium derivative of polyglycol has the formula $$[H_{1-x}-O-(RO)_n-H_{1-y}]Na_{x+y}$$

wherein R is selected from the group consisting of the alkyl radicals $-CH_2CH_2-$ and $-CH_2CH(CH_3)-$, and mixtures thereof; n is an integer between 2 and 400; x and y are between 0 and 1; and $x+y$ is between 0.3 and 1.9.

4. The process of claim 3, wherein $x+y$ is between 0.5 and 1.5.

5. The process of claim 3, wherein $x+y$ is between 0.6 and 1.4.

6. The process of claim 3, wherein the polyglycol has a molecular weight between 40 and 1000 and $x+y$ is between 0.6 and 1.2.

7. The process of claim 1, wherein the reagent comprises from 4 to 10% by weight weakly basic compound, based on the total weight of the reagent.

8. The process of claim 1, wherein the weakly basic compound is selected from the group consisting of carbonates and bicarbonates of sodium, potassium and lithium.

9. The process of claim 1, wherein the decomposing is carried out with stirring and under a nitrogen atmosphere, at a temperature from 100° to 160° C.

10. The process of claim 2, wherein said polyhalogenated aromatic compound is polychlorinated biphenyl and said mineral oil is a transformer oil.

11. A process for decontaminating mineral oils by decomposing polyhalogenated aromatic compounds in said mineral oils, said process comprising contacting said mineral oils under an inert atmosphere with a reagent comprising:
   (a) a sodium derivative of polyethylene glycol having the formula $$[H_{1-x}-O-(CH_2-CH_2-O)_n-H_{1-y}]Na_{x+y}$$

wherein
   n is an integer between 2 and 400,
   x is between 0 and 1,
   y is between 0 and 1, and
   $x+y$ is between 0.3 and 1.9; and
   (b) potassium carbonate in an amount of from 4 to 10% by weight, based on the total weight of the reagent.

* * * * *